US006139284A

United States Patent [19]

Streicher

[11] Patent Number: 6,139,284

[45] Date of Patent: Oct. 31, 2000

[54] RADIAL PISTON PUMP FOR HIGH PRESSURE FUEL DELIVERY

[75] Inventor: Bernd Streicher, Filderstadt, Germany

[73] Assignee: Robert Bosch GmbH, Stuttgart, Germany

[21] Appl. No.: 09/254,633

[22] PCT Filed: Jul. 2, 1998

[86] PCT No.: PCT/DE98/01828

§ 371 Date: May 28, 1999

§ 102(e) Date: May 28, 1999

[87] PCT Pub. No.: WO99/02859

PCT Pub. Date: Jan. 21, 1999

[30] Foreign Application Priority Data

Jul. 11, 1997 [DE] Germany ..... 197 29 789

[51] Int. Cl.[7] ..... F04B 27/04; F04B 1/04

[52] U.S. Cl. ..... 417/273

[58] Field of Search ..... 417/273, 269, 417/470; 92/72, 79; 91/451

[56] References Cited

U.S. PATENT DOCUMENTS

| | | | |
|---|---|---|---|
| 2,271,570 | 2/1942 | Pardee | 417/273 |
| 2,621,607 | 12/1952 | Trapp | 417/273 |
| 4,363,607 | 12/1982 | Eichele et al. | 417/273 |
| 4,983,100 | 1/1991 | Budecker | 417/271 |
| 5,382,140 | 1/1995 | Eisenbacher | 417/273 |
| 5,626,466 | 5/1997 | Ruoff et al. | 417/273 |
| 5,647,729 | 7/1997 | Jong et al. | 417/273 |
| 6,003,430 | 12/1999 | Lang | 92/12.1 |

*Primary Examiner*—Teresa Walberg
*Assistant Examiner*—Vinod D Patel
*Attorney, Agent, or Firm*—Ronald E. Greigg; Edwin E. Greigg

[57] ABSTRACT

A radial piston pump for high-pressure fuel delivery in fuel injection systems of internal combustion engines which includes a common rail injection system. A drive shaft having a number of cam-like projections is supported in a pump housing. A number of pistons disposed radially in cylinder chambers are set into a reciprocating motion in the cylinder chambers upon rotation of the drive shaft. A metallic housing part which constitutes the cylinder chamber is provided with a fuel intake opening and a fuel outlet opening, each of which is controlled by a check valve. The housing part rests with a flat contact surface against a flat contact surface of the metallic housing base body and a projecting section of the housing part, which is concentric to the cylinder chamber extends through a radial opening of the housing base body in the direction toward the drive shaft. The fuel inlet opening and the fuel outlet opening discharge into the flat contact surface and are flush with other inlet and outlet openings in the housing base body. The housing part is tightened against the housing base body by way of screws in such a way that the contact surfaces produce a high-pressure seal without the interposition of sealing elements.

18 Claims, 3 Drawing Sheets

RADIAL PISTON PUMP FOR HIGH PRESSURE FUEL DELIVERY

PRIOR ART

The invention relates to a radial piston pump for high-pressure fuel delivery in fuel injection systems of internal combustion engines, including a common rail injection system, with a drive shaft that is supported in a pump housing and is embodied as eccentric or has a number of cam-like projections in the circumference direction. The system includes a number of pistons that are disposed radially with regard to the drive shaft, each in a respective cylinder chamber, and can be set into a reciprocating motion in the radial direction in the cylinder chamber upon rotation of the drive shaft. Check valves on the intake side and the high-pressure side are provided for each piston. A metallic housing part, which constitutes the respective cylinder chamber, is provided with a fuel inlet opening and a fuel outlet opening.

In radial piston pumps of this kind, the housing part is supported and sealed in relation to other housing regions by a number of elastomer sealing elements. This leads to an indefinite arrangement of the components of the pump.

Based on this, an object of the current invention is to produce a radial piston pump that is a high-pressure-type up to 2000 bar. The high-pressure-affected components and their sealing points uncoupled from each other and in the assembled state, are exactly defined statically.

This object is attained with a radial piston pump of the type described at the beginning, by virtue of the fact that the housing part rests with a flat contact surface against a metallic housing base body from the radial outside with regard to the drive shaft. A projecting section of the housing part, which is concentric to the cylinder chamber and is oriented toward the drive shaft, extends through a radial opening of the housing base body in the direction toward the drive shaft. The fuel inlet opening and a fuel outlet opening discharge into the flat contact surface and are flush with other inlet and outlet openings in the housing base body. The housing part is tightened against the housing base body by way of screws in such a way that the high-pressure side is sealed through the clamping of the high-pressure sealing element.

Whereas in the previously known radial piston pump, the high-pressure seal was also achieved by way of interposed elastomer sealing elements, and the assembly of the components adjoining the high-pressure side—as mentioned at the beginning—included a flux of force over a number of components which led to a static indeterminacy. The invention proposes producing the seal by way of flat metallic contact surfaces of the respective radially outer housing part and the housing base body are tightened against each other. The fuel delivery and the fuel discharge to and from the cylinder chamber occurs by means of the respective fuel inlet opening and the fuel outlet opening, which discharge on the one end, into the intake or compression chamber and on the other end, into the contact surface of the housing part oriented toward the housing base body. The housing part can rest in a statically defined manner against the housing base body without the interposition of any sealing element. When the housing part is tightened against the housing base body, a so-called hard seal is produced by the metallic contact surfaces of the radially outer housing part and the housing base body.

Preferably, all high-pressure-affected sealing points of metallic components that are tightened against one another are embodied without the interposition of additional sealing elements.

To this end, the surfaces of the metallic components that rest against each other in a sealed fashion are machined, in particular lapped, in order to produce a desired surface roughness. If the lapping can only be carried out with difficulty or is altogether impossible because a relevant component has a protruding pin or the like, then a surface quality that is sufficient for producing a hard seal (metal against metal) can also be produced by means of hard turning, i.e. metal-removing machining, after the heat hardening.

In order to assure a correct assembly position, it has turned out to be advantageous that the protruding section of the housing part oriented toward the drive shaft forms a centering collar with which the housing part can be positioned in the radial opening of the housing base body.

In order to keep the unusable dead space in the compression stroke of the pump piston as small as possible and to thus increase the efficiency of the radial piston pump, it has turned out to be advantageous if the intake side check valve and the high-pressure side check valve are integrated into the respective housing part that constitutes the cylinder chamber.

The cylinder chamber could be embodied by a blind bore that extends radially outward in the housing part. In order to be able to machine the wall of the cylinder chamber in a suitable manner, e.g. to lap it, it has turned out to be advantageous, though, if the housing part has a through opening that extends radially in relation to the drive shaft which, constitutes the cylinder chamber, and is sealed on the radial outside by a metallic sealing element that is screwed into the through opening.

In order to seal the through opening by means of the metallic sealing element, this element is advantageously tightened with its end face against an axial step in the through opening in such a way that a high-pressure-tight seal is achieved.

In another improvement of this concept of the invention, an edged or bead-shaped circumferential projection is embodied on the end face of the sealing element and this leads to a sealing, plastic deformation along the projection when the components are tightened against each other. The projection itself, however, is not deformed, but only produces the hard seal of the flat surfaces.

This seal, which is called the biting-edge technique, is not limited to the sealing of the radial through opening in the housing part that constitutes the cylinder chamber by means of the sealing element, but can also be used on other insertion parts, particularly parts that can be screwed in, e.g. the seal of an access opening to a check valve or a high-pressure fitting that can be screwed in.

Other features, details, and advantages of the invention ensue from the graphic representation of the subsequent description of a preferred embodiment of the radial piston pump according to the invention.

BRIEF DESCRIPTION OF THE DRAWINGS

FIGS. 1 and 2 show a radial piston pump for high-pressure fuel delivery in fuel injection systems, particularly in common rail systems, of internal combustion engines. The radial piston pump is designed with an integrated on-demand quantity regulation. The principle of suction throttle regulation is followed as a regulation concept. The fuel delivery and dimensioning is executed by way of a metering unit, not shown.

Figure 1:
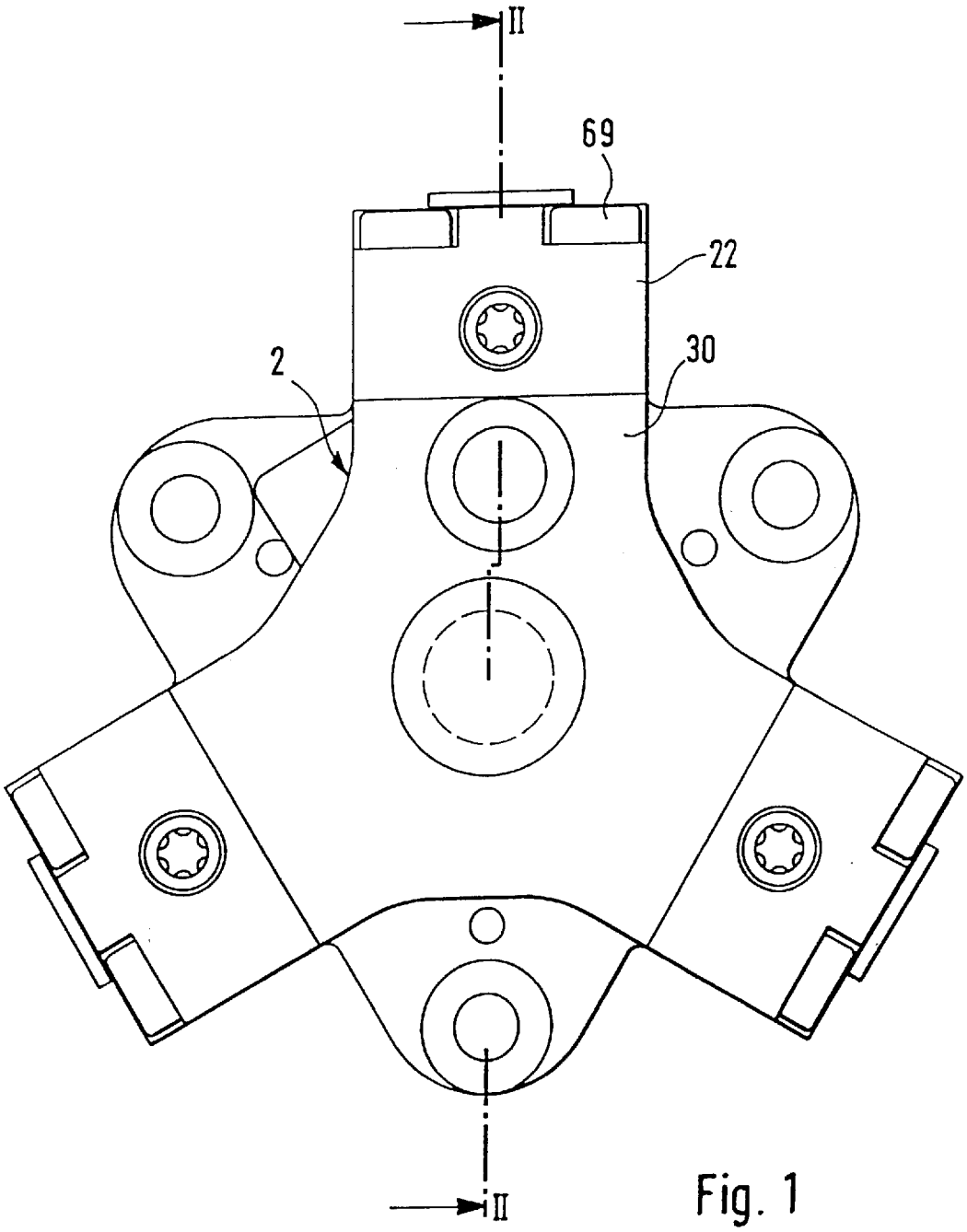
FIG. 1 is a top view of an embodiment of the radial piston pump according to the invention, in the direction of the drive shaft.

The radial piston pump includes a drive shaft 4, which has an eccentrically embodied shaft section 6 and is supported in a pump housing that is identified as a unit with the reference numeral 2. A travel bushing 8 is provided on the eccentric shaft section 6 and can be rotated in relation to the shaft section 6. Three pistons 10 that are disposed offset from one another by 120° in the radial direction are supported against the outer circumference surface of the travel bushing 8, which can be embodied as cylindrical or polygonal. The pistons 10 include a tappet 14 that is guided in a cylinder chamber 12 and on the end of this tappet oriented toward the drive shaft 4, a disk-shaped contact section 16 is embodied, with which the respective piston 10 is supported against the outer circumferential surface of the travel bushing 8, with the initial stress of a spring 18. The cylinder chamber 12 of each tappet 14 is constituted in a radially outer housing part 22 by a through opening 20 that extends radial to the drive shaft 4 and a pump piston 10 that can move radially in this through opening. The housing part 22 is essentially block-shaped and has a contact surface 26, which is oriented toward the drive shaft 4 and extends perpendicular to the longitudinal direction of the through opening 20, with which the housing part 22 rests against a likewise flat contact surface 28 of a housing base body 30, which surface is oriented radially outward away from the drive shaft 4.

A sealing element 32 that is embodied as a screw plug is screwed in a sealed fashion into a diametrically enlarged, radially outer end section 31 of the through opening 20. A disk-shaped element 38, which has a central opening 40 and at least one radial opening 42 leading from the central opening 40, is inserted between the end face 34 of the sealing element 32 and an axial step 36 in the through bore 20. The radial opening 42 communicates with a fuel inlet opening 44 and 46 in the housing part 22, which discharges into the contact surface 26 of the housing part 22 and is flush with another inlet opening 47 in the housing base body 30. An intake side check valve 48 is provided on the side of the disk-shaped element 38 oriented toward the pump piston. It includes a cup-shaped support in which a compression spring is accommodated, which prestresses a disk-shaped valve body against the central opening 40 in the disk element 38. A fuel outlet opening 60 leads away from the cylinder chamber 12, has a high-pressure side check valve 62 accommodated in it, and leads into another fuel outlet opening 61, which likewise discharges into the contact surface 26 of the housing part 22 and is flush with another outlet opening 65 that leads to a high-pressure fitting 64.

The housing part 22 includes a section 66 that protrudes toward the drive shaft 4, is concentric to the cylinder chamber 12, and engages in a radial opening 67 in the housing base body 30. At the transition from the contact surface 26 to the section 66, a centering collar 68 is provided, with which the housing part 22 is positioned in the radial opening 67. The housing part 22 is tightened against the housing base body 30 by way of screws 69 in such a way that the contact surface 26 of the housing part 22 and the contact surface 28 of the housing base body 30 in direct metallic contact against each other, produce a high-pressure seal so that the fuel inlet openings 46, 47 and the other inlet and outlet openings 61, 65 in the housing base body 30 are sealed without requiring the use of additional sealing elements. In this manner, when the radial piston pump is assembled, a statically precisely defined position of the housing part 22 on the housing base body 30 is achieved and all of the high-pressure sealing points are thus uncoupled from one another. Since the check valves 48, 62 are accommodated in the radially outer housing part 22, this housing part can be pre-assembled as a subassembly and separately pressure tested.

The sealing of the diametrically widened radially outer end section 31 of the through opening 20 is carried out by the screw-connected sealing element 32, by virtue of the fact that a bead-shaped projection 70, a so-called biting edge, which encompasses the central opening 40 in the disk element 38, is provided on the end face 34 of the sealing element 32, and this projection "digs into" the metal of the disk element 38 when the sealing element 32 is tightened. This presses the disk element 38 with its opposite side against the axial, hard-turned step 36 in such a way that a high-pressure seal is produced here as well.

In a corresponding manner, a biting edge 74 is also embodied on the end face 72 of the high-pressure fitting 64. A screw plug 76, which seals an assembly/access opening to the high-pressure side check valve 62, is tightened with a biting edge against a step.

Figure 2:
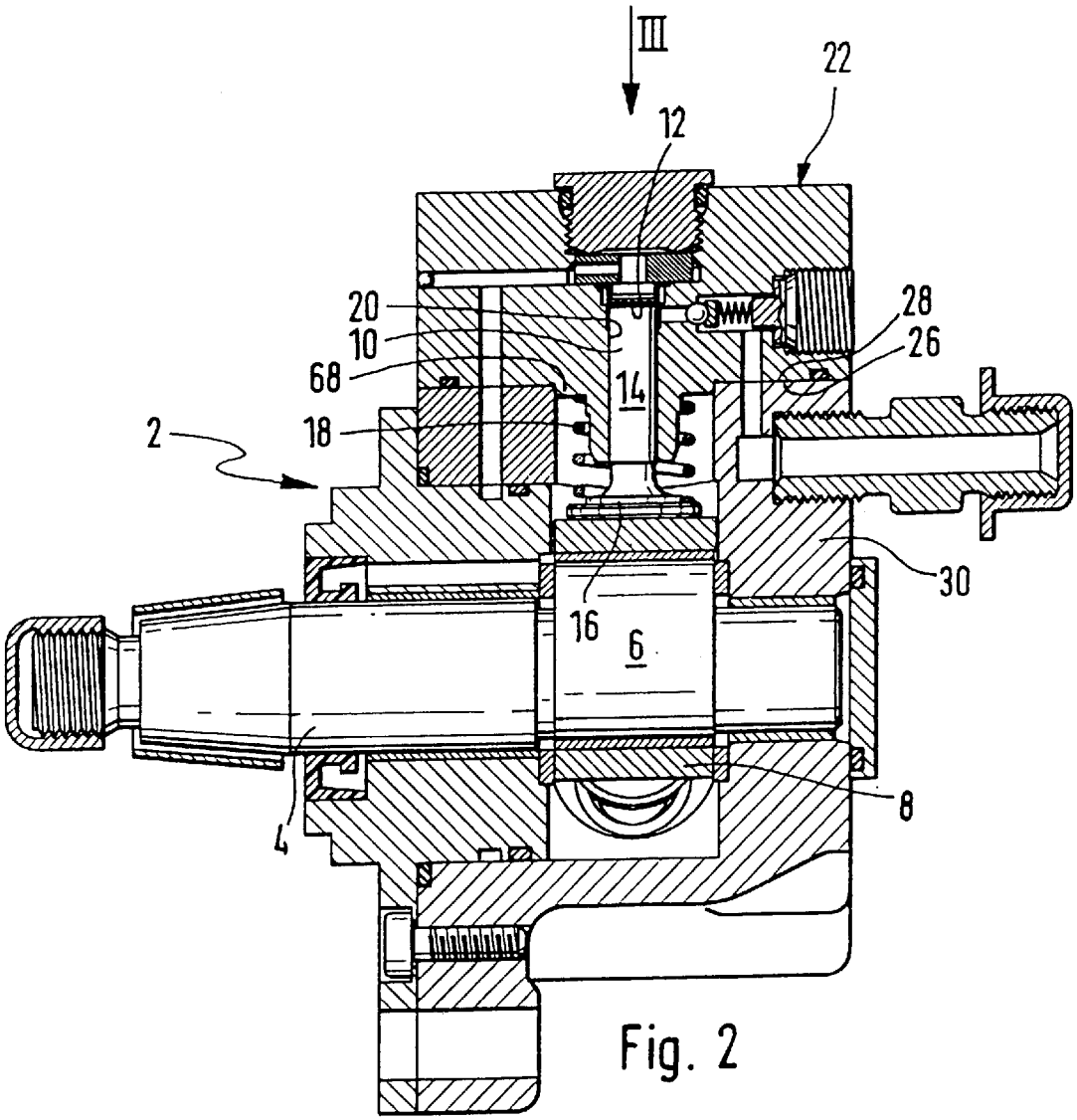
FIG. 2 is a longitudinal section along line II—II in FIG. 1.
Figure 3:
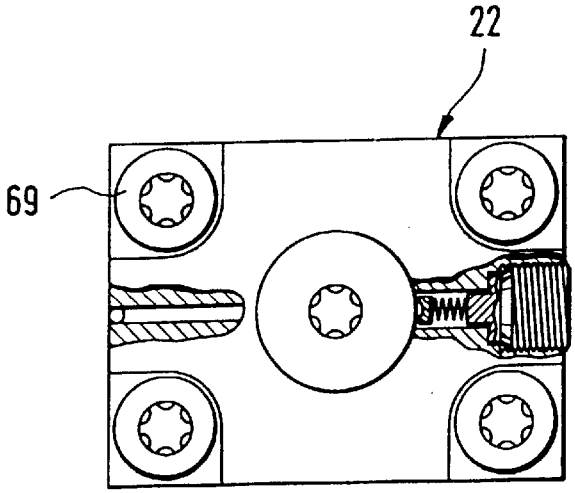
FIG. 3 is a top view of the radially outer housing part that constitutes a cylinder chamber, in the direction of the arrow III—III in FIG. 2.
Figure 4:
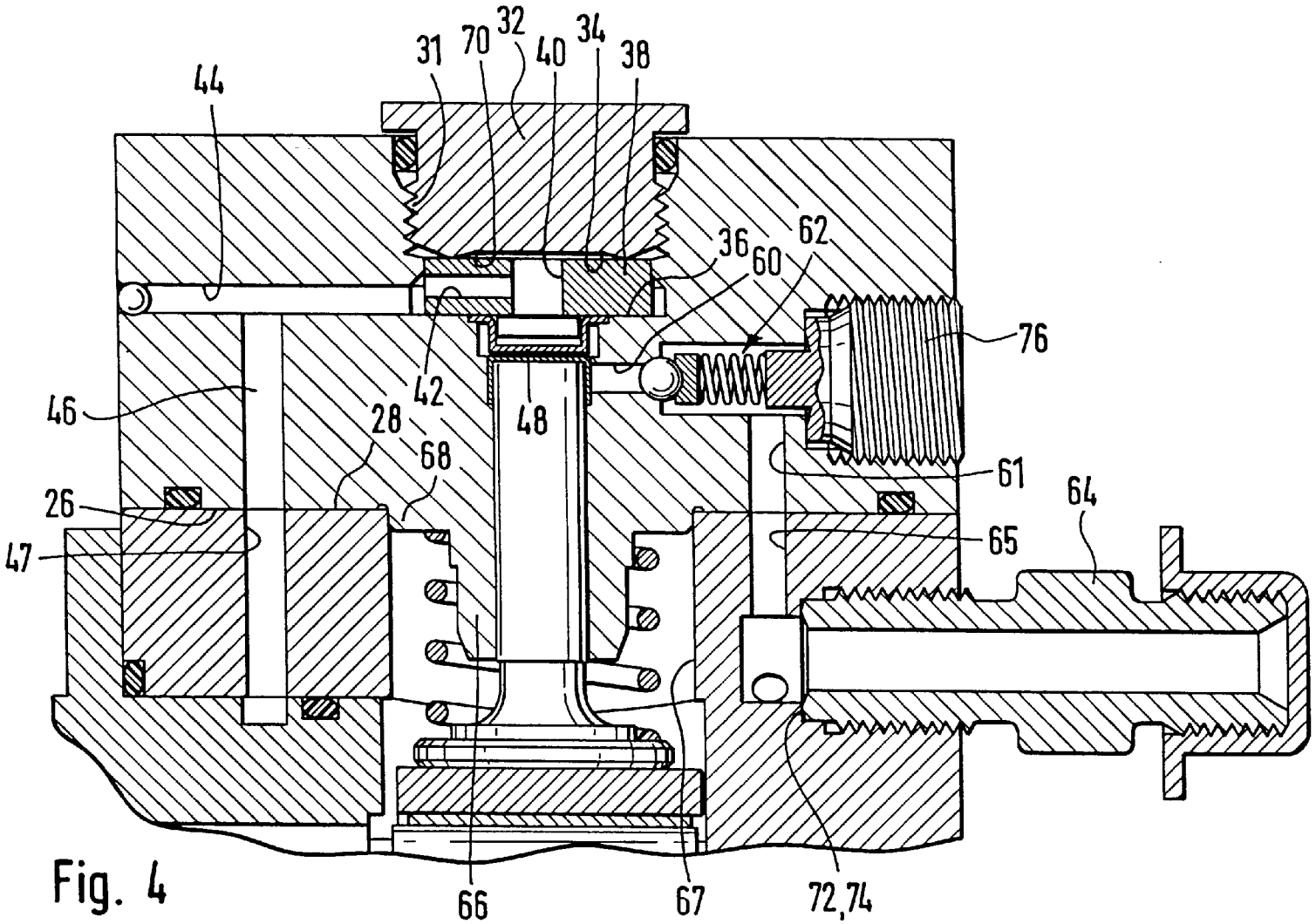
FIG. 4 is an enlarged depiction of a detail from FIG. 2.

When the drive shaft 4 rotates out of the position depicted in FIG. 2, the piston 10 is moved out of the cylinder chamber 12 through the action of the compression spring 18. By means of this, the pressure in the cylinder chamber drops and when to falls below an opening pressure, the intake side check valve 48 opens so that fuel is aspirated into the cylinder chamber by way of the inlet opening 46, 44, 42, 40. With the subsequent compression stroke, the check valve 48 closes and the high-pressure side check valve 62 opens so that high-pressure fuel can be delivered to the high-pressure fitting 64 by way of the outlet opening 60, 61, 65.

The foregoing relates to a preferred exemplary embodiment of the invention, it being understood that other variants and embodiments thereof are possible within the spirit and scope of the invention, the latter being defined by the appended claims.

What is claimed is:

1. A radial piston pump for high-pressure fuel delivery in fuel injection systems of internal combustion engines, which comprises a common rail injection system, a drive shaft (4) that is supported in a pump housing (2) and is embodied eccentrically or has a number of cam-like projections in the circumferential direction, said system includes a number of pistons (10) that are disposed radially with regard to the drive shaft, each in a respective radially extending cylinder chamber (12), said pistons are set into a reciprocating motion in the radial direction in the cylinder chamber upon rotation of the drive shaft (4), check valves (48, 62) on the intake side and the high-pressure side, for each piston (10), a metallic housing part (22), which constitutes the respective cylinder chamber (12), is provided with a fuel intake opening (44, 46) and a fuel outlet opening (60, 61), the housing part (22) rests with a flat contact surface (26) against a flat contact surface (28) of the metallic housing base body (30) from the radial outside with regard to the drive shaft (4), and a projecting section (66) of the housing part (22), which is concentric to the cylinder chamber (12) and is oriented toward the drive shaft, extends through a radial opening (67) of the housing base body (30) in a direction toward the drive shaft (4), the fuel inlet opening (46) and the fuel outlet opening (61) discharge into the flat contact surface (26) and are flush with other inlet and outlet openings (47, 65) in the housing base body (30), and that the housing part (22) is tightened against the housing base body (30) by means of screws (69) in such a way that the contact surfaces (26, 28) produce a high-pressure seal without the interposition of sealing elements.

2. The radial piston pump according to claim 1, in which all high-pressure-affected sealing points of metallic components (22, 30; 32, 38; 64) that are tightened against each other are formed without the interposition of elastomer sealing elements.

3. The radial piston pump according to claim 2, in which the protruding section (66) of the housing part (22) oriented toward the drive shaft forms a centering collar (68) with which the housing part (22) can be positioned in the radial opening (67) of the housing base body (30).

4. The radial piston pump according to claim 3, in which the intake side check valve (48) and the high-pressure side check valve (62) are integrated into the housing part (22).

5. The radial piston pump according to claim 2, in which the intake side check valve (48) and the high-pressure side check valve (62) are integrated into the housing part (22).

6. The radial piston pump according to claim 2, in which the housing part (30) has a through opening (20) that extends radially in relation to the drive shaft (4), constitutes the cylinder chamber (12), and is sealed radially from the outside by a metallic sealing element (32) that is screwed into the through opening (20).

7. The radial piston pump according to claim 2, in which an edged or bead-shaped circumferential projection (70, 74) is embodied on one of the sealing surfaces of the metallic components (32, 38; 22; 64, 30; 76, 22), which rest against each other, and leads to a sealing, plastic deformation along the projection.

8. The radial piston pump according to claim 1, in which the protruding section (66) of the housing part (22) oriented toward the drive shaft forms a centering collar (68) with which the housing part (22) can be positioned in the radial opening (67) of the housing base body (30).

9. The radial piston pump according to claim 8, in which the intake side check valve (48) and the high-pressure side check valve (62) are integrated into the housing part (22).

10. The radial piston pump according to claim 8, in which the housing part (30) has a through opening (20) that extends radially in relation to the drive shaft (4), constitutes the cylinder chamber (12), and is sealed radially from the outside by a metallic sealing element (32) that is screwed into the through opening (20).

11. The radial piston pump according to claim 8, in which an edged or bead-shaped circumferential projection (70, 74) is embodied on one of the sealing surfaces of the metallic components (32, 38; 22; 64, 30; 76, 22), which rest against each other, and leads to a sealing, plastic deformation along the projection.

12. The radial piston pump according to claim 1, in which the intake side check valve (48) and the high-pressure side check valve (62) are integrated into the housing part (22).

13. The radial piston pump according to claim 12, in which the housing part (30) has a through opening (20) that extends radially in relation to the drive shaft (4), constitutes the cylinder chamber (12), and is sealed radially from the outside by a metallic sealing element (32) that is screwed into the through opening (20).

14. The radial piston pump according to claim 12, in which an edged or bead-shaped circumferential projection (70, 74) is embodied on one of the sealing surfaces of the metallic components (32, 38; 22; 64, 30; 76, 22) , which rest against each other, and leads to a sealing, plastic deformation along the projection.

15. The radial piston pump according to claim 1, in which the housing part (30) has a through opening (20) that extends radially in relation to the drive shaft (4), constitutes the cylinder chamber (12), and is sealed radially from the outside by a metallic sealing element (32) that is screwed into the through opening (20).

16. The radial piston pump according to claim 15, in which the metallic sealing element (32) is tightened with an end face (34) against an axial step (36) in the through opening (20) in such a way that a high-pressure-tight seal is produced.

17. The radial piston pump according to claim 16, in which an edged or bead-shaped circumferential projection (70) is embodied on the end face (34) of the sealing element (32) and leads to a sealing, plastic deformation along the projection.

18. The radial piston pump according to claim 1, in which an edged or bead-shaped circumferential projection (70, 74) is embodied on one of the sealing surfaces of the metallic components (32, 38; 22; 64, 30; 76, 22), which rest against each other, and leads to a sealing, plastic deformation along the projection.

* * * * *